US010563907B2

(12) United States Patent
Hixon

(10) Patent No.: US 10,563,907 B2
(45) Date of Patent: Feb. 18, 2020

(54) ADJUSTABLE, TWO-POSITION SUPPORT BRACKET FOR SUPPORTING A WORK SURFACE

(71) Applicant: Elkhart Plastics, Inc., South Bend, IN (US)

(72) Inventor: Jacob M. Hixon, Portland, OR (US)

(73) Assignee: Elkhart Plastics, Inc., South Bend, IN (US)

( * ) Notice: Subject to any disclaimer, the term of this patent is extended or adjusted under 35 U.S.C. 154(b) by 0 days.

(21) Appl. No.: 15/952,667

(22) Filed: Apr. 13, 2018

(65) Prior Publication Data

US 2019/0316834 A1 Oct. 17, 2019

(51) Int. Cl.

| | |
|---|---|
| ***F25D 23/12*** | (2006.01) |
| ***A47B 3/12*** | (2006.01) |
| ***A47B 3/10*** | (2006.01) |
| ***F25D 3/06*** | (2006.01) |
| ***F25D 23/06*** | (2006.01) |
| ***F25D 25/02*** | (2006.01) |
| ***B65D 25/28*** | (2006.01) |

(Continued)

(52) U.S. Cl.

CPC ..... *F25D 23/12* (2013.01); *A47B 3/10* (2013.01); *A47B 3/12* (2013.01); *B65D 25/06* (2013.01); *B65D 25/2841* (2013.01); *B65D 43/165* (2013.01); *F25D 3/06* (2013.01); *F25D 23/069* (2013.01); *F25D 25/02* (2013.01); *B65D 2525/286* (2013.01); *B65D 2543/00194* (2013.01); *B65D 2543/00296* (2013.01); *F25D 2400/08* (2013.01)

(58) Field of Classification Search

CPC . A45C 11/20; A45C 13/28; F25D 3/08; F25D 3/06; F25D 2400/08; A47B 3/10; A47B 3/12; B65D 43/16; B65D 2525/286; B65D 2525/288; B65D 25/28; B65D 25/2802; B65D 2525/28; B65D 2525/281; B65D 25/2835; B65D 2543/00; B65D 2543/00101; B65D 2543/00185; B65D 2543/00194

USPC ..... 220/592.03, 770, 269; 248/313, 311.2, 248/309.1, 213.2, 205.1

See application file for complete search history.

(56) References Cited

U.S. PATENT DOCUMENTS 3,979,007 A * 9/1976 Thornbloom, Jr. .... A45C 11/20 220/522

4,515,421 A * 5/1985 Steffes ..... A45C 11/20 312/351

(Continued)

*Primary Examiner* — Shawn M Braden

(74) *Attorney, Agent, or Firm* — Gardner, Linn, Burkhart & Ondersma LLP

(57) ABSTRACT

A cooler includes a chest portion and a lid. The chest portion defines a cavity within the chest portion. The lid is also formed of molded plastic and is attached via a hinge along an edge of an opening of the chest portion. The opening of the chest portion is also an opening of the cavity. The cooler assembly also includes a pair of handle assemblies attached to the chest portion on opposite sides. An insertable bracket is configured to hold a handle of a handle assembly in an extended position, extending away from the side of the chest portion at substantially a right angle to the side of the chest portion. The bracket is further configured to retain and hold a panel along a side edge of the opening of the chest portion, and with the panel resting against the extended handle.

27 Claims, 16 Drawing Sheets

(51) Int. Cl.
*B65D 25/06* (2006.01)
*B65D 43/16* (2006.01)

(56) References Cited

U.S. PATENT DOCUMENTS

| | | | | | |
|---|---|---|---|---|---|
| 5,551,558 | A * | 9/1996 | Bureau | A45C 9/00 | 190/11 |
| 6,315,149 | B1 * | 11/2001 | Conrado | A45C 5/14 | 220/521 |
| 6,796,319 | B1 * | 9/2004 | Patarra | A45B 11/00 | 108/138 |
| 9,132,598 | B2 * | 9/2015 | Ernst | B30B 9/32 | |
| 9,550,605 | B1 * | 1/2017 | Summers | B65D 21/0215 | |
| 2007/0023439 | A1 * | 2/2007 | Vaughn | F25D 3/08 | 220/592.03 |
| 2016/0015202 | A1 * | 1/2016 | Beckman | B65D 25/28 | 220/573.1 |
| 2016/0045022 | A1 * | 2/2016 | Shannon | A47B 3/10 | 108/28 |
| 2017/0086576 | A1 * | 3/2017 | Smith | A47B 23/06 | |
| 2018/0132606 | A1 * | 5/2018 | Long, Jr. | A45C 13/262 | |

* cited by examiner

ADJUSTABLE, TWO-POSITION SUPPORT BRACKET FOR SUPPORTING A WORK SURFACE

The present invention is directed to coolers and storage chests, and, in particular, to coolers and storage chests with extra work surfaces and improved clearances.

BACKGROUND OF THE INVENTION

Conventional coolers, also known as portable ice chests or ice boxes, come in a host of different sizes and shapes, and are made from a variety of materials. Conventional coolers are used to keep food and/or beverages cold by adding ice or frozen products (e.g., ice) along with the desired food or beverages. While disposable coolers are often made from molded polystyrene foam, reusable coolers are commonly made with layers of molded plastic, with a layer of foam or other insulating material between the layers of molded plastic. Such reusable coolers are usually equipped with one or more handles, as well as one or more hinged lids.

SUMMARY OF THE INVENTION

An exemplary cooler assembly of the present invention includes a chest portion and a lid. The chest portion is formed of molded plastic that defines a cavity within the chest portion for the storage of goods to be kept cool. The lid is also formed of molded plastic and is attached via a hinge along an edge of an opening of the chest portion. The opening of the chest portion is also an opening of the cavity. The cooler assembly also includes a pair of handle assemblies attached to the chest portion on opposite sides. An insertable bracket is configured to hold a handle of a first handle assembly in an extended position, extending away from the side of the chest portion. The bracket is further configured to hold a panel along a side edge of the opening of the chest portion, and with the panel resting against the extended handle.

In an aspect of the present invention, the bracket has a hinged, rotating portion that rotates up to hold the handle of the first handle assembly up and away from the side of the chest.

In another aspect of the present invention, the cooler further includes a second insertable bracket for holding a handle of a second handle assembly away from the opposite side of the chest. The second bracket is configured to hold a second panel along an opposite side edge of the opening of the chest and resting against the extended handle of the second handle assembly.

In a further aspect of the present invention, the hinged, rotating portion of the bracket inserts into a recessed portion or groove of the handle to hold the handle up and away from the side of the chest.

In one aspect of the present invention, the lid includes a chamfered edge such that the lid has clearance to rotate upward even when the cooler is placed near or against a vertical surface. The chamfered edge may be placed along an edge of the lid above the hinge joining the chest portion and lid.

These and other objects, advantages, purposes and features of the present invention will become apparent upon review of the following specification in conjunction with the drawings.

DETAILED DESCRIPTION

Figure 1A:
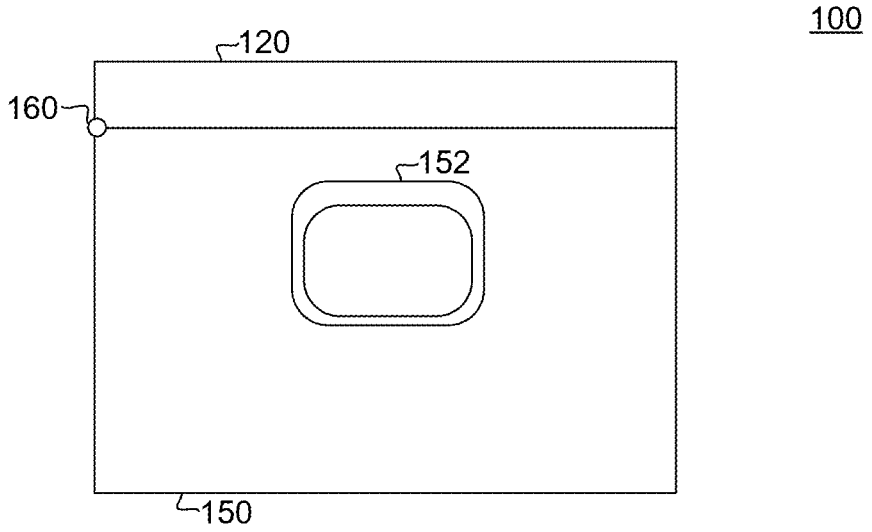
FIG. 1A is a side plane view of a conventional cooler and lid assembly.
Figure 1B:
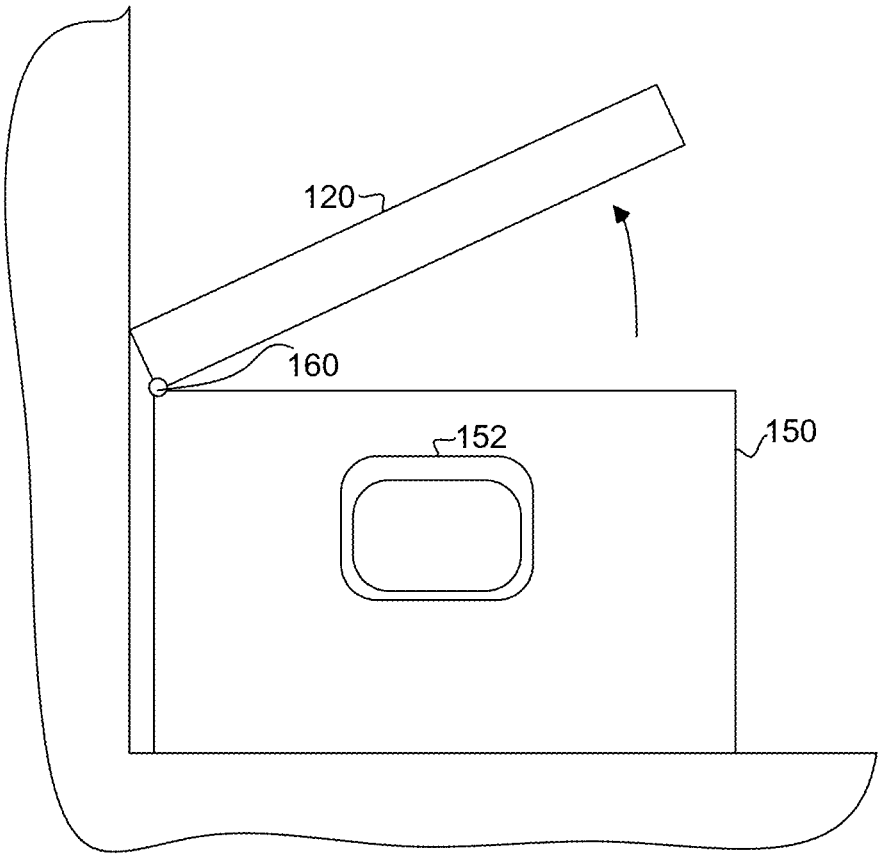
FIG. 1B is a side plane view of the conventional cooler and lid assembly of FIG. 1A, with the lid lifting upward and contacting a nearby wall or other vertical surface.

Referring now to the drawings and the illustrative embodiments depicted therein, a conventional cooler 100 is illustrated in FIG. 1A. The cooler 100 includes a lid 120 and a chest portion 150. The lid 120 and chest portion 150 are joined with a hinge 160 along the back edges of the chest 150 and lid 120. The chest portion 150 may also include a handle 152. The hinge 160 allows the lid 120 to be "lifted" or raised to reveal the interior of the chest 150. As illustrated in FIG. 1B, when the lid 120 is raised with the chest 150 resting against, or near, a wall or other vertical surface (e.g., another cooler), the lid 120 will be prevented from lifting all the way open.

As discussed herein, an exemplary cooler of the present invention will include one or more chamfered edges along at least one edge of the lid such that the lid may be opened even when the cooler is pushed up against a wall or against some other vertical surface. Further embodiments include insertable brackets that when inserted into handles that provide for a stable, horizontal surface for the attachment of panels which provide additional work surfaces. As discussed herein, an exemplary insertable bracket may include a hinged portion that is rotatable to be inserted into a groove or cavity of the handle to hold the handle in a horizontal position, extending away from the cooler and providing a flat surface to support a panel that will rest on the handle and be secured in a C-shaped portion of the bracket. As also discussed herein, the panel, once secured and supported, provides a work surface alongside the cooler.

Figure 2A:
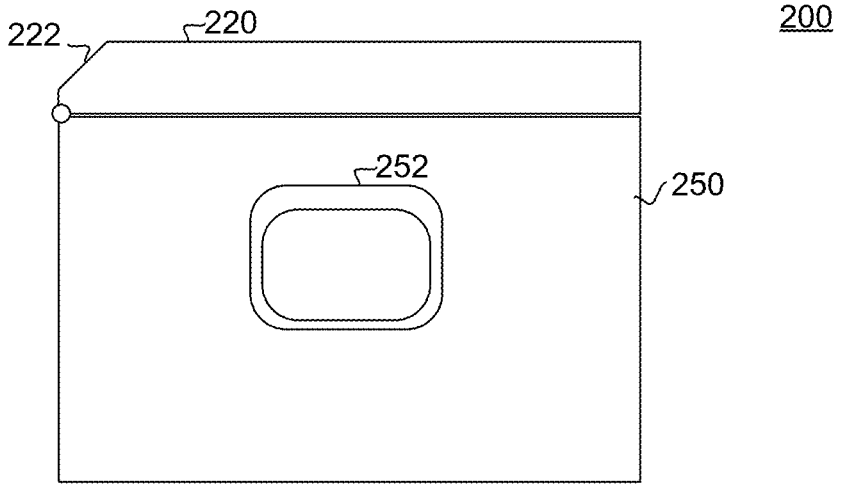
FIG. 2A is a side plane view of an exemplary cooler and lid assembly with a chamfered edge on one side of the lid in accordance with an embodiment of the present invention.
Figure 2B:
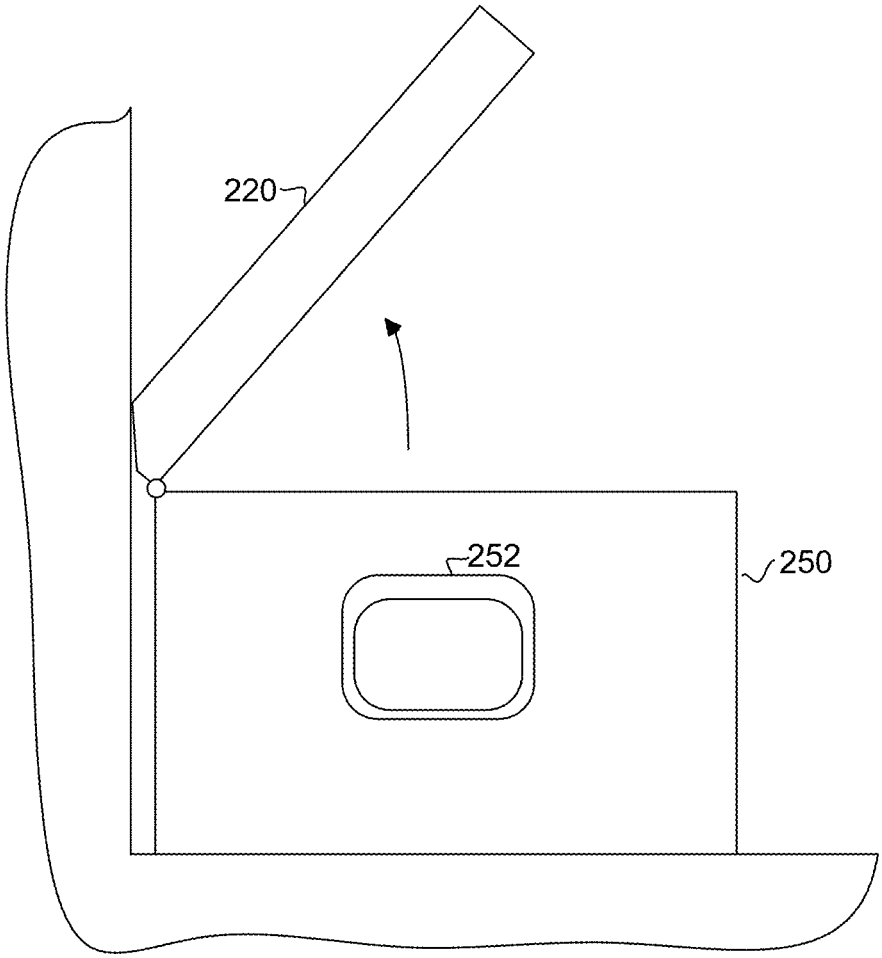
FIG. 2B is a side plane view of the exemplary cooler and lid assembly of FIG. 2A, with the lid lifting upward in accordance with an embodiment of the present invention.

FIG. 2A illustrates an exemplary cooler 200 that includes a lid 220 with an exemplary chamfered edge 222, and a chest portion 250. The chamfering is exemplary in nature. Other angles and amounts of chamfering are possible. The lid 220 and chest portion 250 are joined with a hinge 160 along back edges of the chest 150 and lid 220. The hinge 160, as discussed herein, also allows the lid 220 to be lifted or raised to reveal the interior of the chest 250. As illustrated in FIG. 2B, when the lid 220 is raised with the chest resting against, or near, a wall or other vertical surface, the lid 220 will be able to rotate farther open than illustrated in FIG. 1B.

Figure 3A:
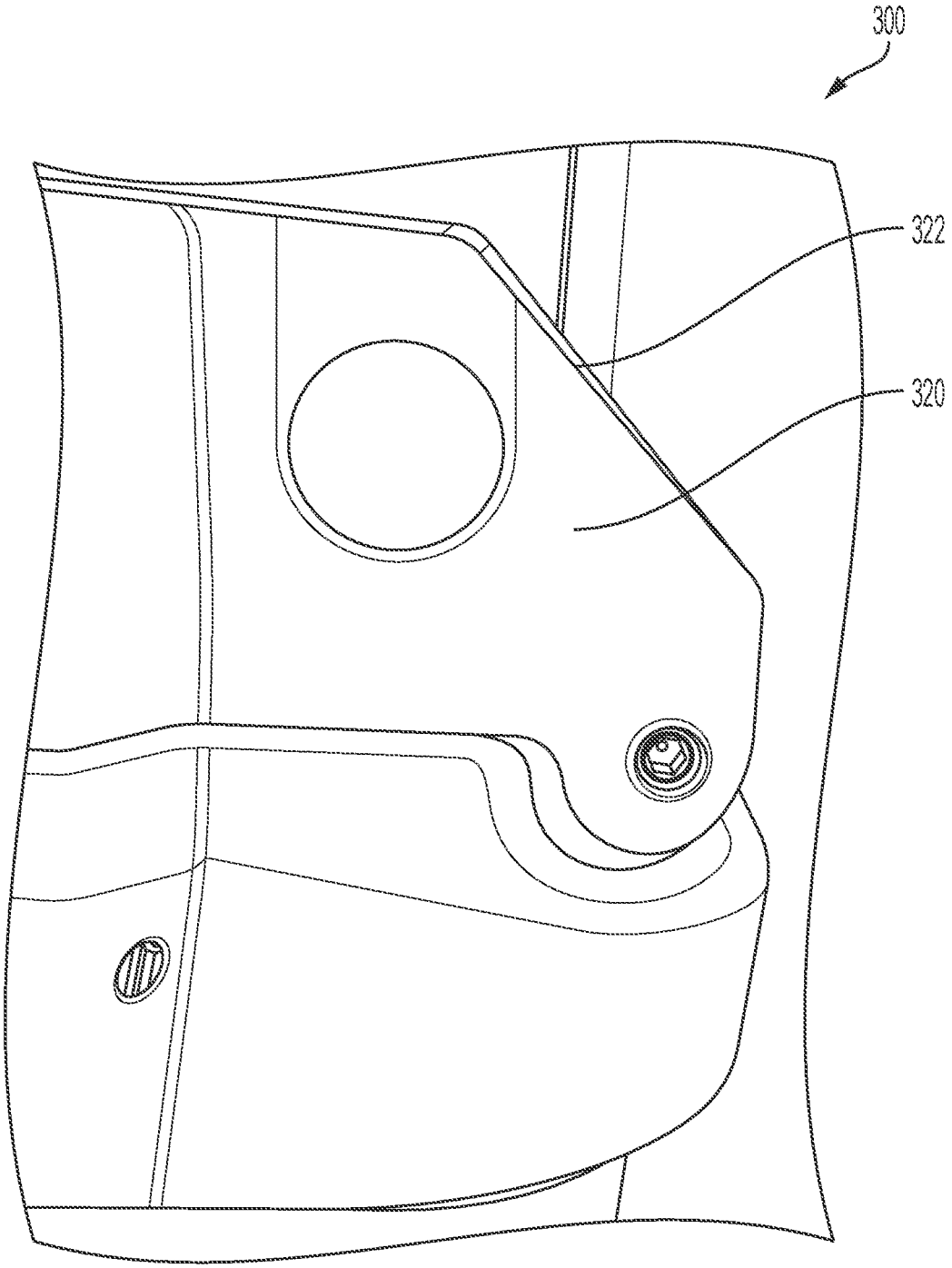
FIG. 3A is a side plane view of another exemplary cooler and lid assembly with a chamfered edge on one side of the lid in accordance with an embodiment of the present invention.
Figure 3C:
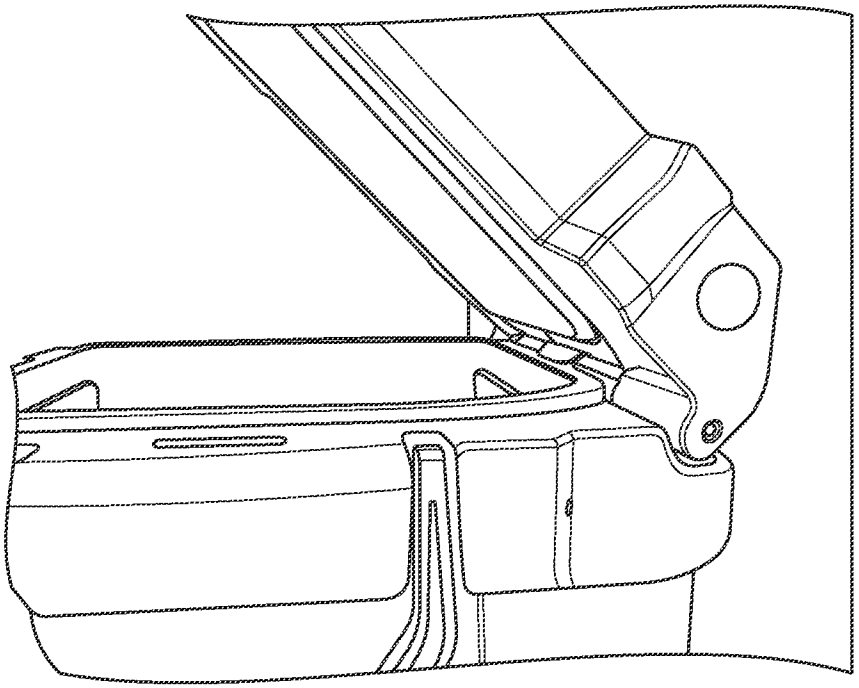
FIGS. 3B and 3C are side plane views of the exemplary cooler and lid assembly of FIG. 3A, with the lid lifting upward in accordance with an embodiment of the present invention.
Figure 3B:
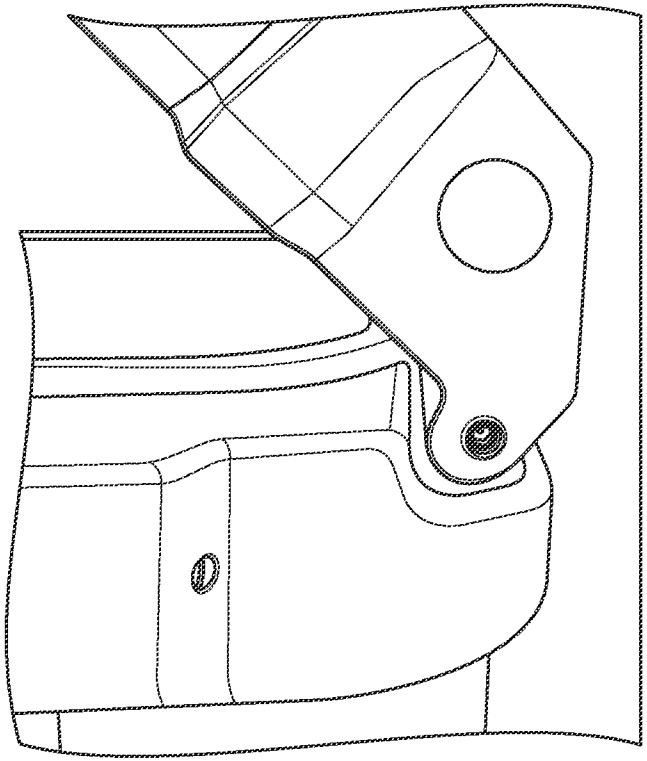

FIG. 3A illustrates another exemplary cooler 300 comprising a chest portion and a hinged lid 320 with a chamfered edge 322. As illustrated in FIG. 3A, the cooler 300 is positioned against a vertical surface. FIGS. 3B and 3C illustrate the lid 320 of the cooler 300 of FIG. 3A lifted upward, with the chamfered edge 322 resting against the vertical surface and still allowing the lid 320 to be opened. As discussed herein, the chamfering 322 illustrated in FIG. 3A is exemplary in nature and other chamfering, rounding, or cornering of edges may also be used.

Figure 4:
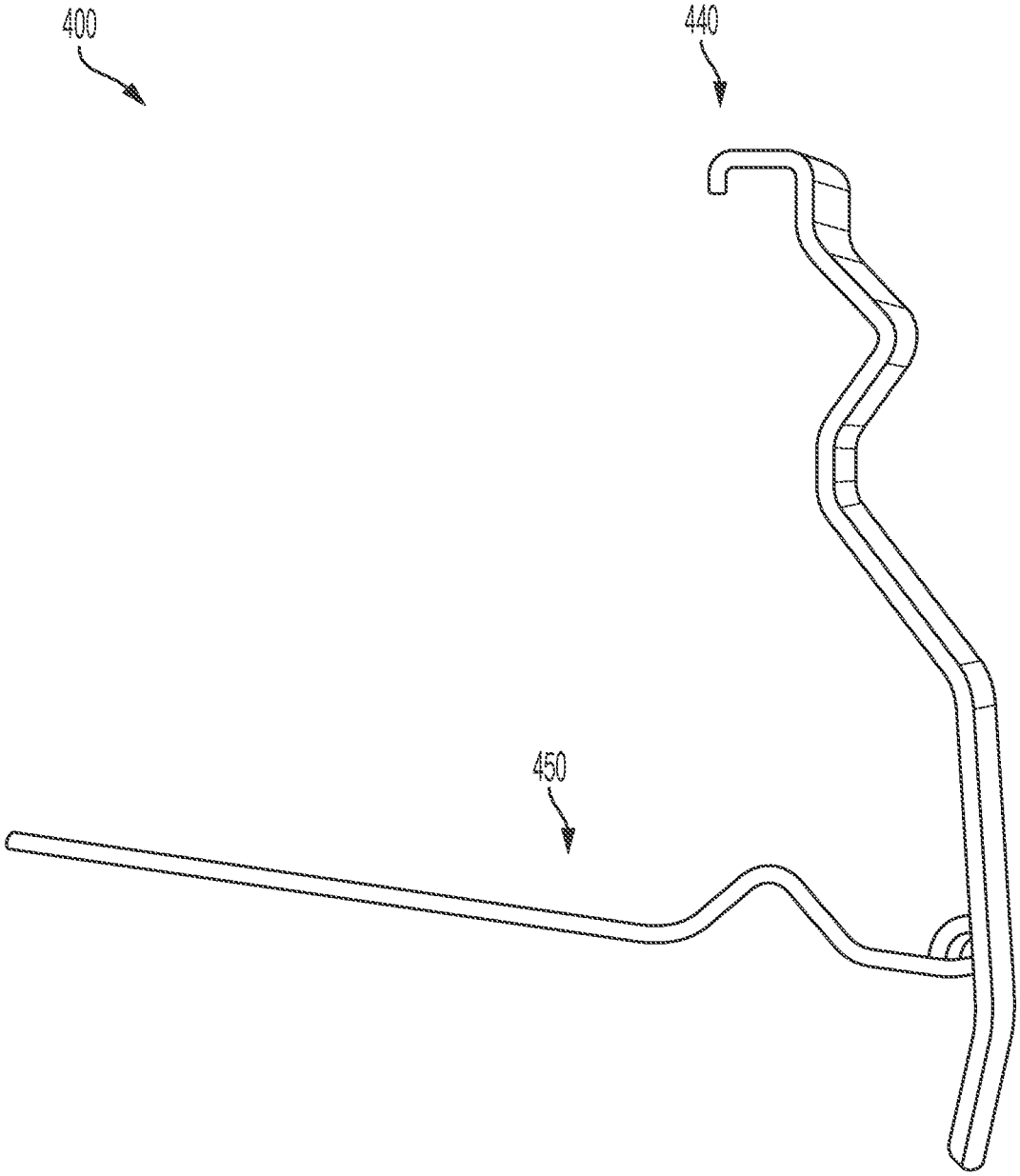
FIG. 4 is a side plane view of an exemplary bracket with an exemplary hinged, rotating portion in accordance with an embodiment of the present invention.
Figure 5A:
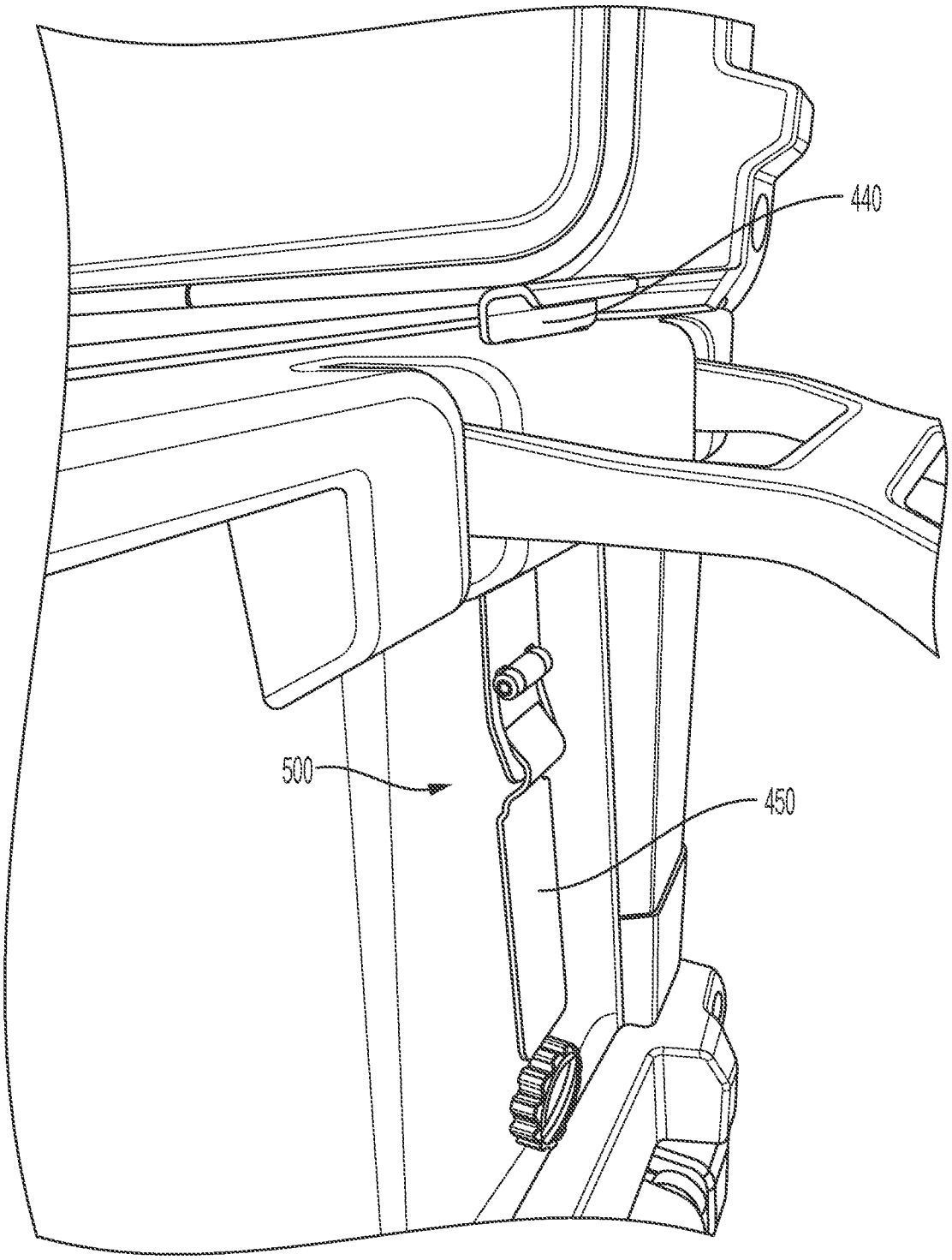
FIG. 5A is a right-side, corner view of an exemplary cooler with the bracket of FIG. 4 inserted into a handle assembly and resting in a storage position in accordance with an embodiment of the present invention.

FIG. 4 illustrates an exemplary bracket 400 that is insertable into a handle assembly 552 of a cooler 500 (see FIG. 5A). The bracket 400 includes a C-shaped portion 440 that is used to retain and support a panel 700 (see FIG. 7B). The bracket 400 further includes a hinged, rotating portion 450 that may be rotated up and inserted into a grooved or indented portion of a handle of the handle assembly 552 to hold the handle up and away from the side of the cooler 500 (see FIGS. 6A and 6B).

In an aspect of the present invention, a bracket 400 may be formed of any light-weight, yet durable material, such as aluminum and aluminum alloys, as well as other metals and their alloys.

Figure 5B:
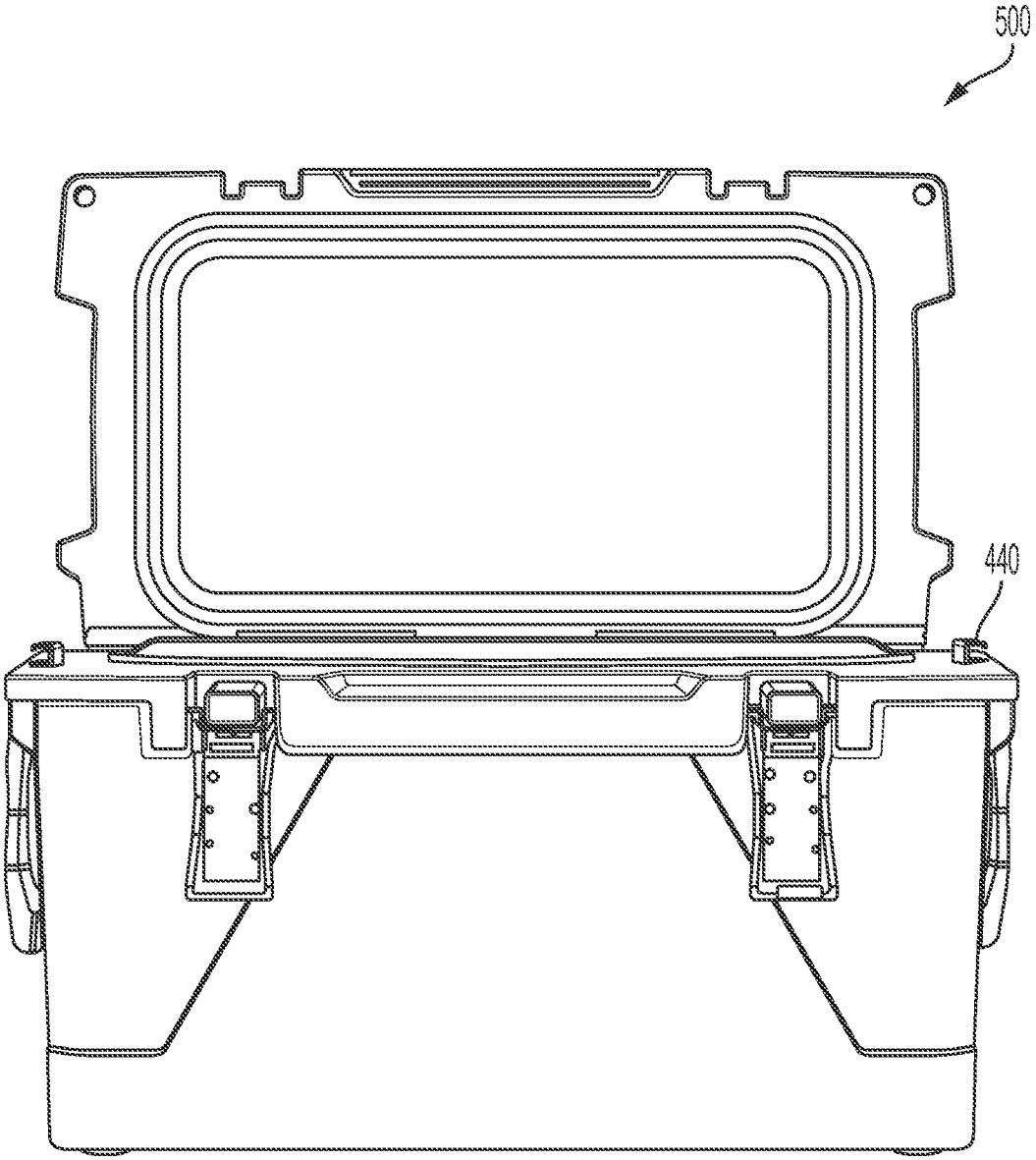
FIG. 5B is a front plane view of an exemplary cooler with the bracket of FIG. 4 inserted into handle assemblies on either side of the cooler, with the handles resting against the inserted brackets in accordance with an embodiment of the present invention.
Figure 5C:
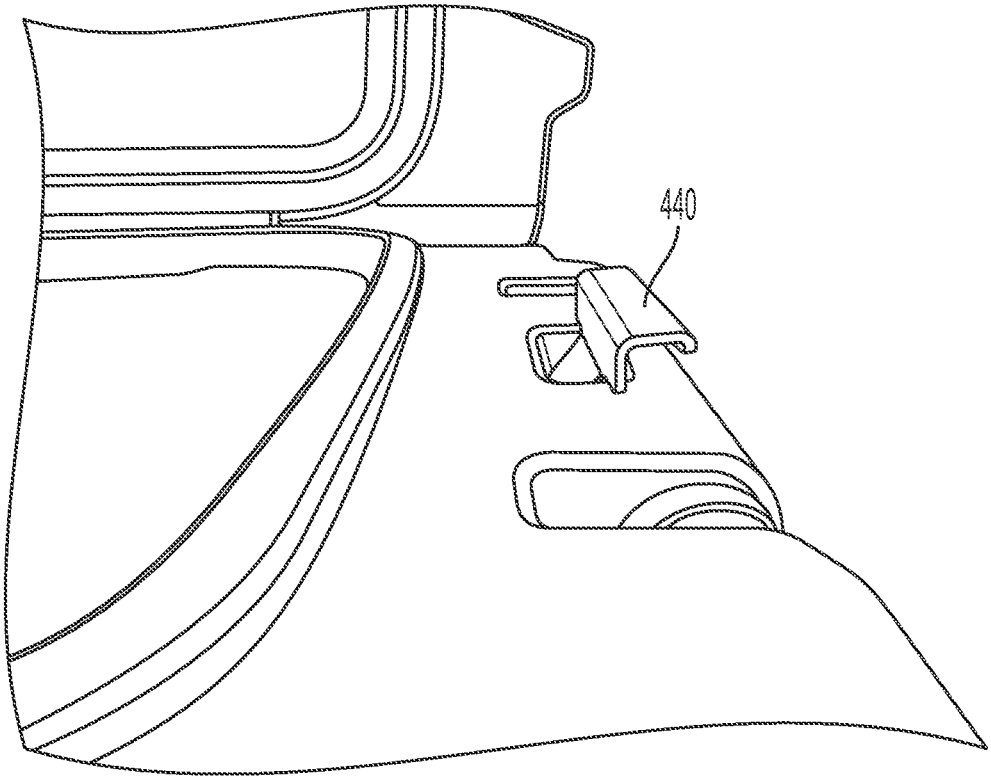
FIG. 5C is a right-side, surface view of an exemplary cooler with the bracket of FIG. 4 inserted into a handle assembly and a C-shaped portion of the bracket extending above the handle assembly to receive and retain an edge of a panel in accordance with an embodiment of the present invention.
Figure 5D:
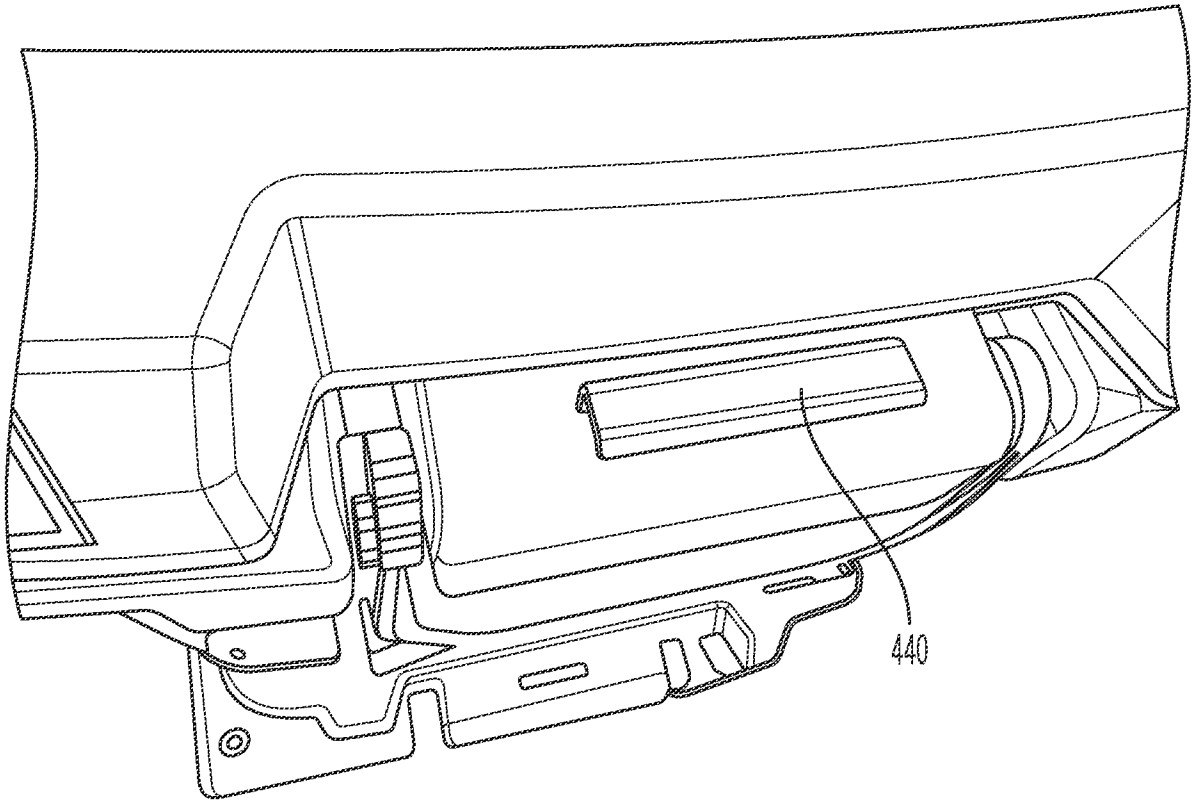
FIG. 5D is a top down view of the exemplary cooler and bracket of FIG. 5C with the lid closed in accordance with an embodiment of the present invention.

FIGS. 5A-5D illustrate brackets 400 inserted into handle assemblies 552 of the cooler 500. As illustrated in FIGS. 5A and 5C, once the bracket 400 is inserted into the handle assembly 552, the C-shaped portion 440 extends above the handle assembly 552 and is in position to retain and support a panel 800 (see FIG. 7B). When the bracket 400 is inserted into the handle assembly 552, the bracket 400 may be left in a "resting position" as illustrated in FIGS. 5A and 5B, where the hinged, rotating portion 450 is left hanging down. As illustrated in FIG. 5B, when the bracket 400 is in the resting position, the handle of the handle assembly 552 may also be left in a position, resting against the bracket 400, and specifically against the hinged, rotating portion 450 of the bracket 400. As illustrated in FIG. 5D, the lid 520 of the cooler 500 may be closed with the bracket 400 inserted into the handle assembly 552. In one embodiment, the brackets 400 are only insertable into the handle assemblies 552 when the handle is lifted up and away from the side of the cooler 500, opening a channel in the handle assembly for the bracket 400 to be maneuvered through the handle assembly 552 and into its resting position.

Figure 6A:
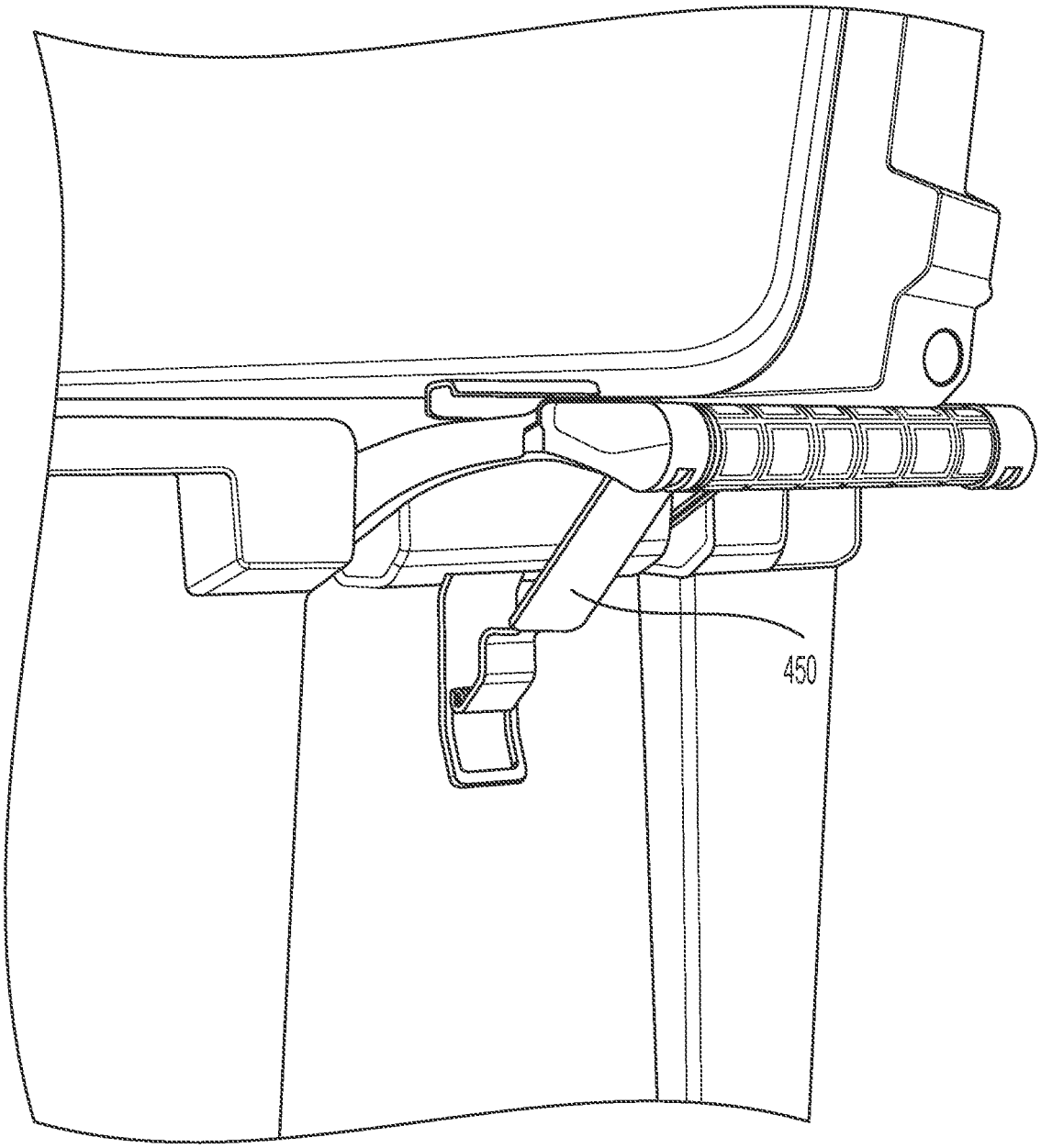
FIG. 6A is a right side, corner view of the cooler and bracket of FIG. 5C, with a hinged, rotating portion of the bracket rotated upward and supporting the handle in a vertical position, extending away from the cooler in accordance with an embodiment of the present invention.
Figure 6B:
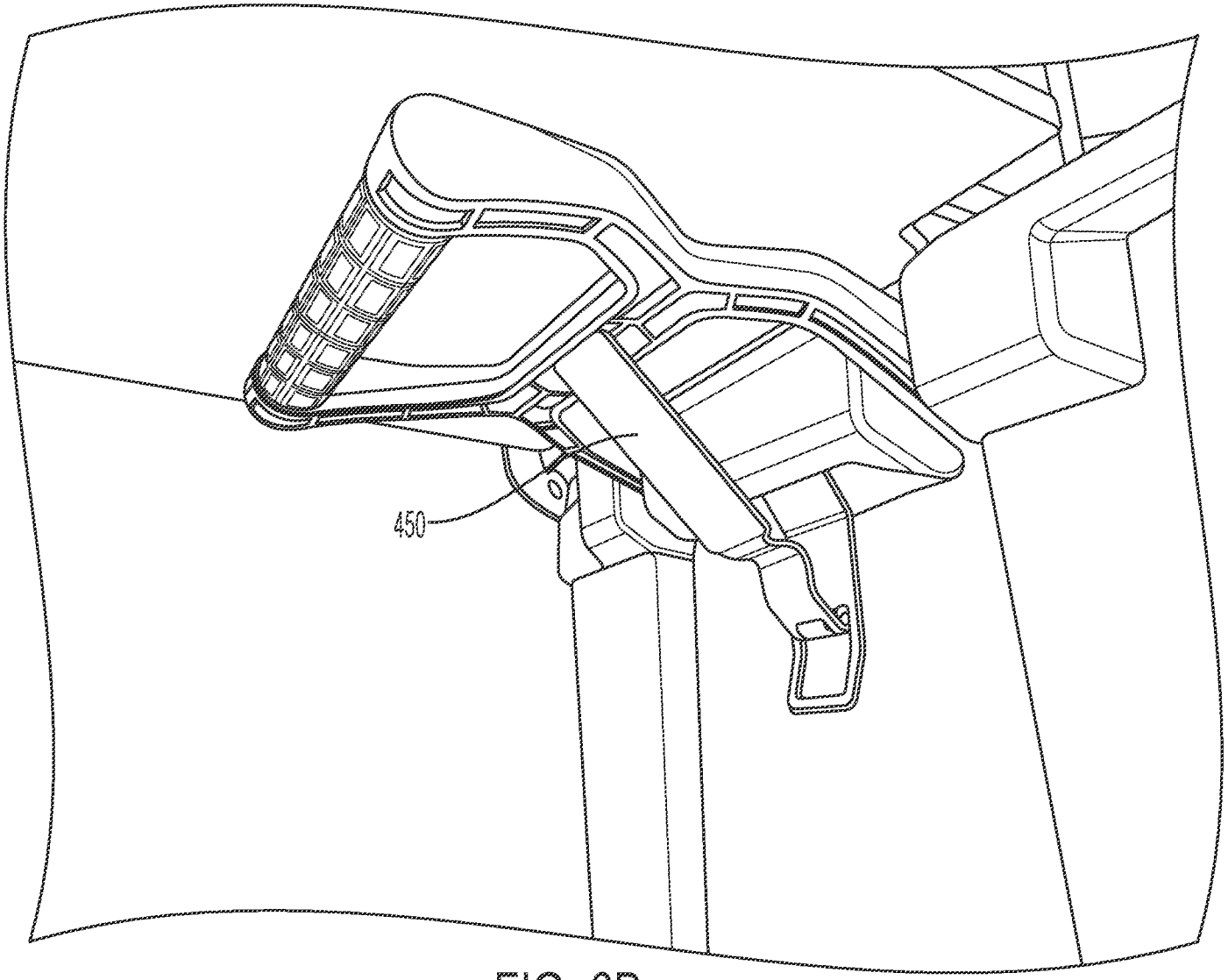
FIG. 6B is a left side, corner view of the cooler and the bracket of FIG. 5B, mirroring the view of FIG. 5C, with a hinged, rotating portion of the bracket rotated upward and inserted into a groove or recessed portion of the handle to support the handle in a vertical position, and extending the handle away from the cooler in accordance with an embodiment of the present invention.

FIGS. 6A and 6B illustrate the hinged, rotating portion 450 of the bracket 400 rotated up and inserted into a grooved or recessed portion on the underside of the handle of the handle assembly 552. With the hinged, rotating portion 450 in position, inserted into or against the underside of the handle of the handle assembly 552, the handle is retained and supported, extending away from the side of the cooler 500 (see FIGS. 6A and 6B).

Figure 7A:
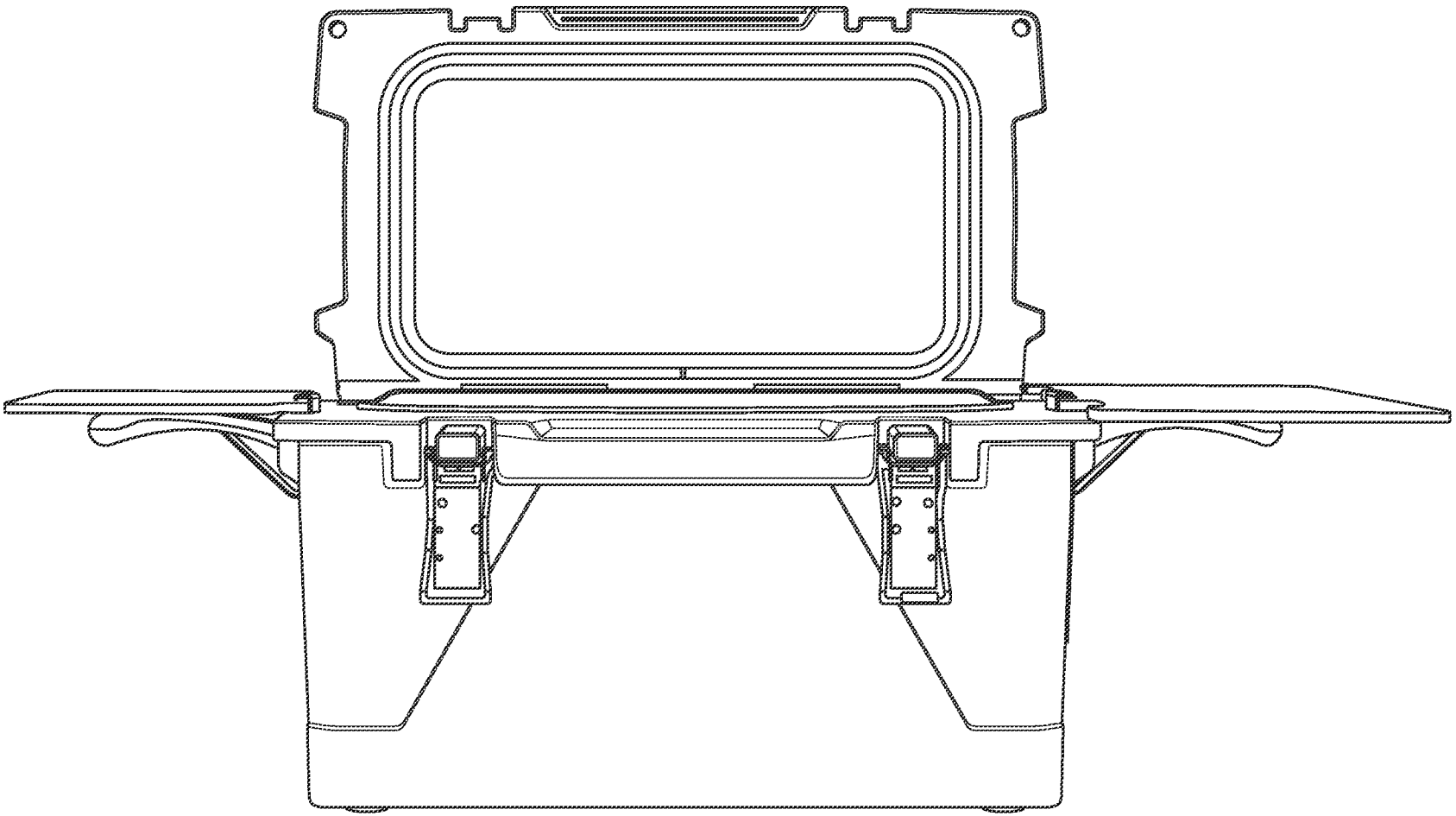
FIG. 7A is a front plane view of the cooler of FIGS. 5 and 6, and further illustrating panels inserted and retained into C-shaped portions of respective brackets, as illustrated in FIG. 5C, such that the panels are retained by the brackets and rest upon the handles in accordance with an embodiment of the present invention.
Figure 7B:
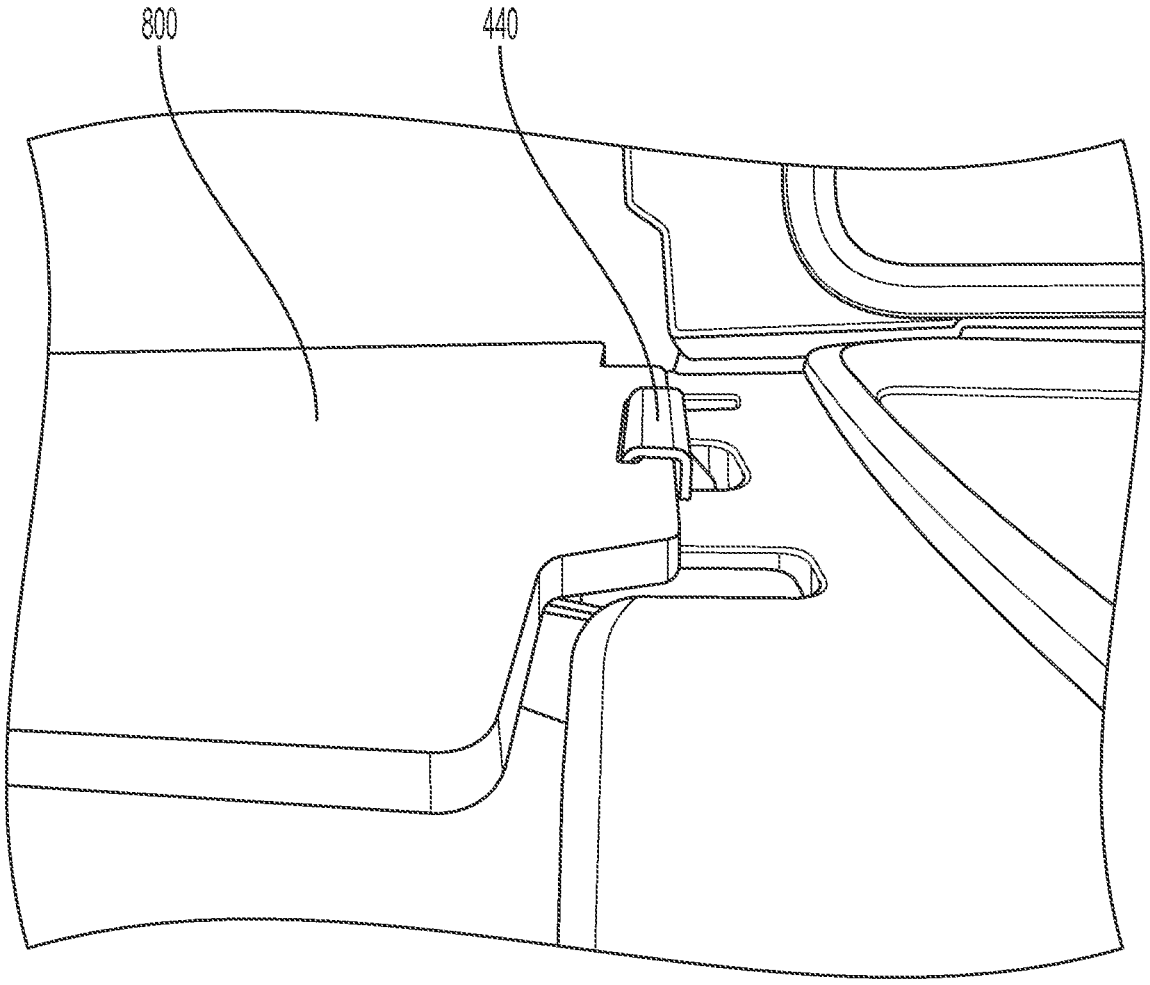
FIG. 7B is a left-side, surface view of the cooler of FIG. 7A, illustrating a panel inserted and retained by a C-shaped portion of a bracket inserted into the left-side handle assembly in accordance with an embodiment of the present invention.
Figure 7C:
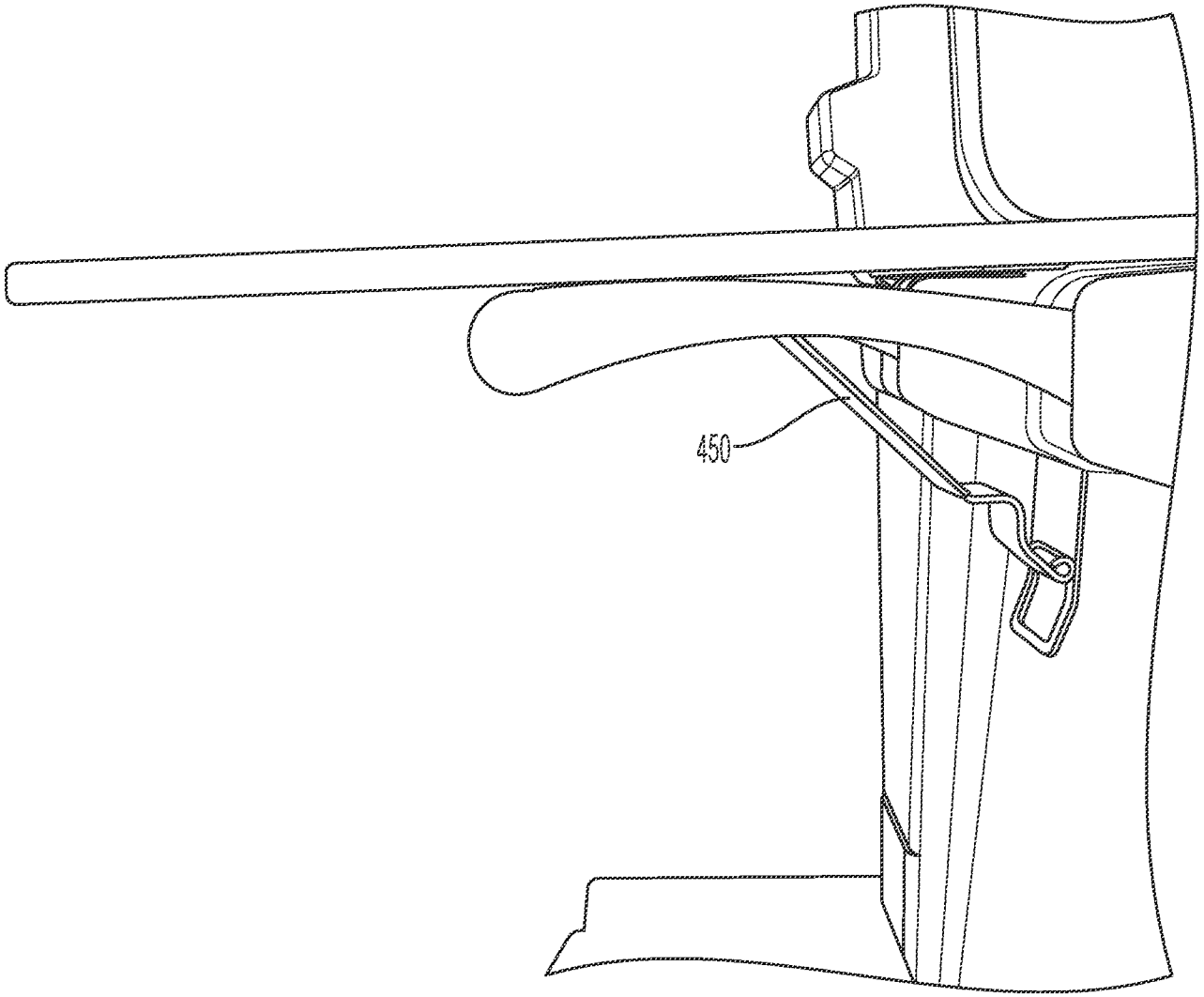
FIG. 7C is a left-side, corner view of the cooler of FIG. 7B, illustrating another view of the bracket retaining and supporting the handle into an extending position as well as retaining and supporting the panel upon the handle in accordance with an embodiment of the present invention.

As illustrated in FIGS. 7A-7C, with the handles retained and supported, extending from the sides of the cooler 500, panels 800 may then be inserted into the C-shaped extensions 440 of the brackets 400 and be retained and supported upon the handle. As also illustrated in FIGS. 7A-7C, the supported panels 800 provide work surfaces on the side of the cooler 500. While FIG. 7A illustrates brackets 400 and panels 800 positioned on either side of the cooler 500, a single bracket supported panel may be used on either side of the cooler 500.

Figure 8A:
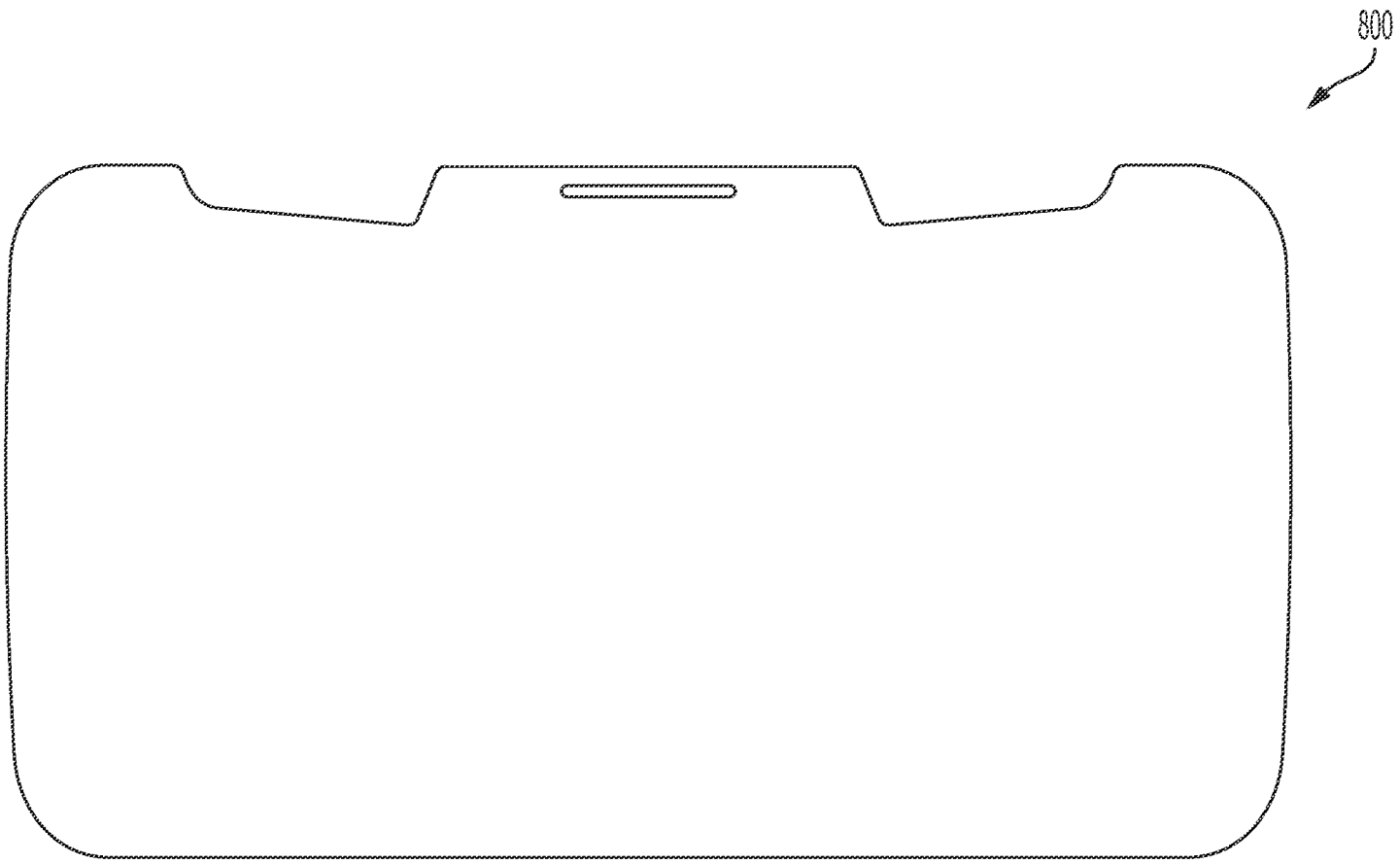
FIG. 8A is a top-down view of a panel of FIGS. 7A-7C in accordance with an embodiment of the present invention.
Figure 8B:
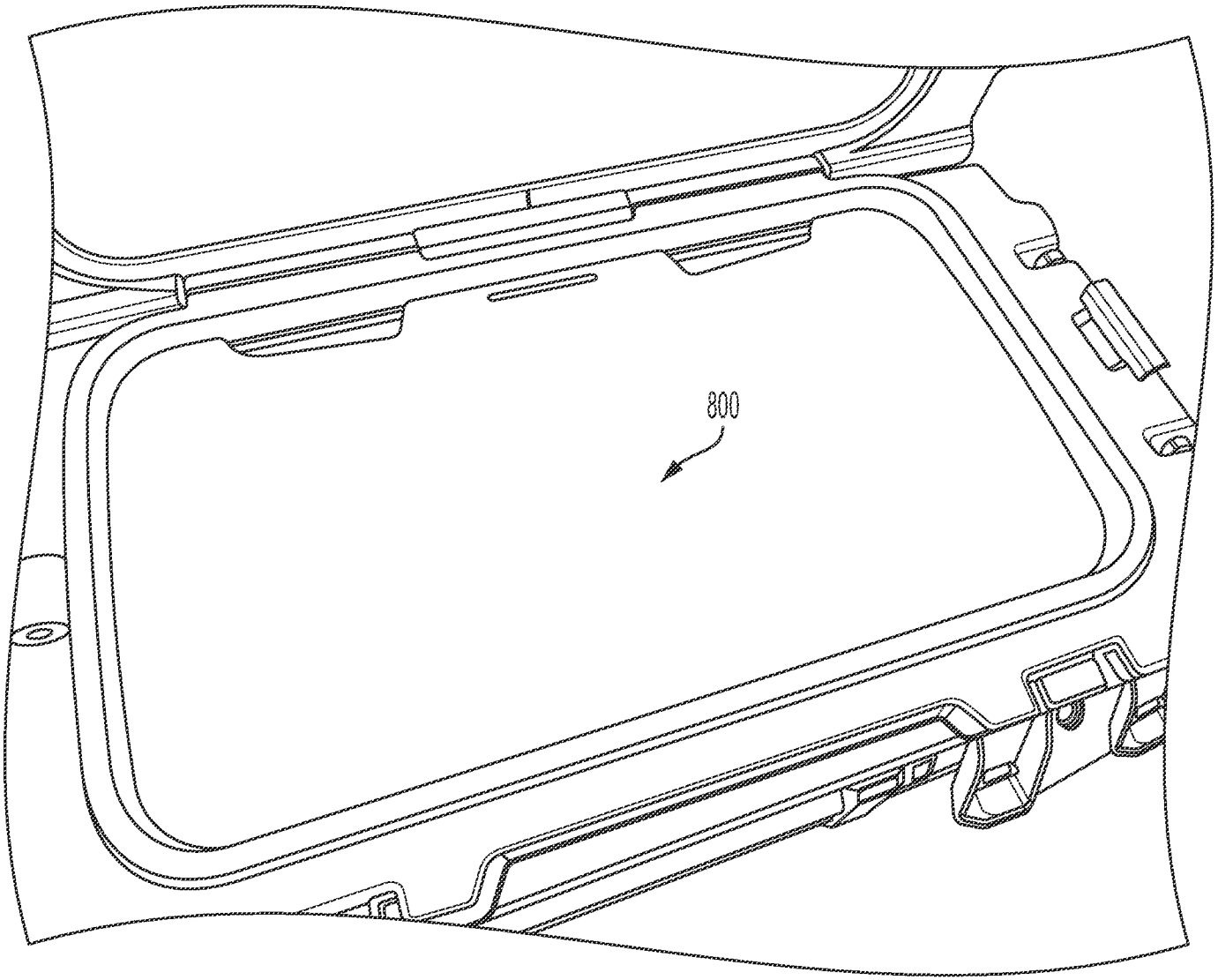
FIG. 8B is a top-down view of a panel of FIGS. 7A-7C in a storage position within a cavity of the cooler of FIGS. 6A-6B and 7A-7C in accordance with an embodiment of the present invention.

FIGS. 8A and 8B illustrate an exemplary panel 800 that may be stored within the cooler 500. Other embodiments of the panel 800 are also possible. Other exemplary panels include different dimensions, such that wider, narrower, longer, and shorter panels are possible to provide a selectable working surface. In one exemplary embodiment, a panel 800 may be used as a divider inside the cooler, as well as used as a working surface retained and supported outside the cooler, as discussed herein. Still other embodiments may utilize the panels 800 discussed herein as dividers or shelves within the cooler 500, in addition to their use as working surfaces outside the cooler when retained and supported by the brackets 400.

In an aspect of the present invention, a panel 800 may be formed of molded plastic, or other materials, such as wood products. Other materials suitable for forming the panel described herein may also be used.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The invention claimed is:

1. A cooler assembly comprising:

a chest portion that defines a cavity within the chest portion for the storage of goods to be kept cool, wherein an opening of the chest portion is also an opening of the cavity;

a pair of handle assemblies attached to the chest portion on opposite sides;

a first bracket configured to removably insert into a first handle assembly of the pair of handle assemblies, and once inserted, configured to hold a handle of the first handle assembly in an extended position, extending away from the side of the chest portion; and a first panel, wherein the first bracket, while inserted, is further configured to retain and hold the first panel along a side edge of the opening of the chest portion, and wherein the first panel rests against the extended handle of the first handle assembly.

2. The cooler assembly of claim 1, wherein the first bracket comprises a hinged, rotating portion that rotates up to hold the handle of the first handle assembly up and away from the side of the chest portion.

3. The cooler assembly of claim 2, wherein the hinged, rotating portion rotates up to insert into a grooved or recessed under portion of the handle of the first handle assembly.

4. The cooler assembly of claim 1 further comprising a second bracket configured to hold a handle of a second handle assembly away from the opposite side of the chest.

5. The cooler assembly of claim 4, wherein the second bracket is configured to retain and hold a second panel along an opposite side edge of the opening of the chest portion, wherein the second panel rests against the extended handle of the second handle assembly.

6. The cooler assembly of claim 1 further comprising a lid, that is attached via a hinge along an edge of the opening of the chest portion, wherein the lid comprises a chamfered edge along one side edge, and wherein the chamfering is above the hinge connecting the lid to the chest portion.

7. The cooler assembly of claim 6, wherein the chest portion and the lid are each formed of molded plastic.

8. The cooler assembly of claim 1, wherein the first panel provides a working surface adjacent the cooler assembly.

9. The cooler assembly of claim 1, wherein the first panel is configured to be stored within the cavity of the chest portion.

10. The cooler assembly of claim 1, wherein the first panel is configured as an insertable partition for partitioning the cavity of the chest portion.

11. The cooler assembly of claim 1, wherein the first panel is configured as an insertable shelf for placement within the cavity of the chest portion.

12. The cooler assembly of claim 1, wherein the first handle assembly is configured such that lifting the handle provides access for insertion of the first bracket into the first handle assembly.

13. A storage assembly comprising:

a chest portion that defines a cavity within the chest portion for the storage of goods wherein an opening of the chest portion is also an opening of the cavity;

a pair of handle assemblies attached to the chest portion on opposite sides;

a first panel insertably contained within the cavity and configured to subdivide the cavity into a plurality of sub-cavities; and a two-position first bracket, wherein for a first position, the first bracket is configured to removably connect to a first handle assembly of the pair of handle assemblies, and wherein for a second position, the first bracket when connected to the first handle assembly, is configured to hold a handle of the first handle assembly in an extended position, extending away from the side of the chest portion;

wherein the first bracket, while connected to the first handle assembly and in the second position, is further configured to retain and hold the first panel along a side edge of the opening of the chest portion, wherein the first panel is configured for removal from the cavity and to rest against the extended handle of the first handle assembly.

14. The storage assembly of claim 13, wherein the first bracket comprises a hinged, rotating portion that rotates up to hold the handle of the first handle assembly up and away from the side of the chest portion, and wherein the hinged, rotating portion is rotated up when in the second position.

15. The storage assembly of claim 14, wherein the hinged, rotating portion rotates up to insert into a grooved or recessed under portion of the handle of the first handle assembly.

16. The storage assembly of claim 13 further comprising a second bracket configured to hold a handle of a second handle assembly away from the opposite side of the chest.

17. The storage assembly of claim 16, wherein the second bracket is configured to retain and hold a second panel along an opposite side edge of the opening of the chest portion, wherein the second panel rests against the extended handle of the second handle assembly.

18. The storage assembly of claim 13 further comprising a lid, that is attached via a hinge along an edge of the opening of the chest portion, wherein the lid comprises a chamfered edge along one side edge, and wherein the chamfering is above the hinge connecting the lid to the chest portion.

19. The storage assembly of claim 18, wherein the chest portion and the lid are each formed of molded plastic.

20. The storage assembly of claim 13, wherein the first panel while resting against the extended handle of the first handle assembly, provides a working surface adjacent the cooler assembly.

21. The storage assembly of claim 13, wherein the first panel is further configured as an insertable shelf for placement within the cavity of the chest portion.

22. The storage assembly of claim 13, wherein the first handle assembly is configured such that lifting the handle provides access for insertion of the first bracket into the first handle assembly.

23. A storage assembly comprising:

a chest portion configured to define a cavity within the chest portion for the storage of goods;

a lid, wherein the lid in a closed position covers the cavity of the chest portion, and wherein the lid in an open position provides access to the cavity of the chest portion;

a pair of handles pivotally connected to opposite sides of the chest portion, wherein each handle comprises a respective outer end that is adapted to be grasped for carrying the cooler;

a first panel selectively removably mounted in the cavity of the chest portion and configured to subdivide the cavity into a plurality of sub-cavities, wherein the first panel is adapted to be removably secured to the chest portion to extend away from one of the sides of the chest portion and supported by a first handle of the pair of handles; and a bracket selectively mounted to extend between the chest portion and the first handle when in a raised position and bracing the first handle against the first panel.

24. The storage assembly of claim 23, wherein the bracket comprises a hinged, rotating portion that rotates up to hold the first handle up and away from the side of the chest portion.

25. The storage assembly of claim 24, wherein the hinged, rotating portion rotates up to insert into a grooved or recessed under a portion of the handle of the first handle assembly.

26. The storage assembly of claim 23, wherein the first panel provides a working surface adjacent the cooler assembly.

27. The storage assembly of claim 23, wherein the first handle is configured such that lifting the first handle provides access for insertion of the bracket into the first handle.

* * * * *